US006305580B1

(12) United States Patent
Chen

(10) Patent No.: US 6,305,580 B1
(45) Date of Patent: Oct. 23, 2001

(54) PRESS-TYPE PERFUME SPRAYER

(76) Inventor: Sin-Hsiung Chen, P.O. Box 90, Tainan City (TW)

( * ) Notice: Subject to any disclaimer, the term of this patent is extended or adjusted under 35 U.S.C. 154(b) by 0 days.

(21) Appl. No.: 09/746,009

(22) Filed: Dec. 26, 2000

(51) Int. Cl.[7] ..... B67D 5/64

(52) U.S. Cl. ..... 222/162; 222/182; 222/153.11; 222/321.7; 222/321.9; 222/183

(58) Field of Search ..... 222/162, 182, 222/183, 153.11, 153.13, 321.7, 321.9, 321.8

(56) References Cited

U.S. PATENT DOCUMENTS 3,080,989 * 3/1963 Ramsbotham ..... 215/12
3,254,803 * 6/1966 Meshberg ..... 222/182
3,429,310 * 2/1969 Jaffe et al. ..... 128/173
4,098,436 * 7/1978 Kohlbeck ..... 222/182
4,324,348 * 4/1982 Johnson et al. ..... 222/181
4,449,474 * 5/1984 Mariol ..... 116/2
4,454,966 * 6/1984 Hicks ..... 222/153
5,226,563 * 7/1993 Coggiola ..... 222/95
5,458,263 * 10/1995 Ciammitti et al. ..... 222/153.1
5,464,125 * 11/1995 Daansen ..... 222/156
5,487,489 * 1/1996 Weiss et al. ..... 222/1
5,791,525 * 8/1998 Fan ..... 222/181.3
6,230,889 * 5/2001 Chen ..... 206/446

* cited by examiner

*Primary Examiner*—Kevin Shaver
*Assistant Examiner*—Frederick C Nicolas

(57) ABSTRACT

A press-style perfume sprayer includes a body having a chamber for containing a perfume bottle, a push block supporting the bottom of the perfume bottle, a base combined with the bottom of the body, a front side cover and a rear side cover pivotally combined with the body, and an upper cap closing on the body. Pressing the rear side cover pushes the perfume bottle up, forcing a spray nozzle head to spray the perfume in the perfume bottle out of the spray nozzle. The press-style perfume prayer is easy to use and convenient to carry, protecting the perfume bottle from misused or damaged, and having an elegant and beautiful appearance and practicality.

7 Claims, 3 Drawing Sheets

PRESS-TYPE PERFUME SPRAYER

BACKGROUND OF THE INVENTION

1. Field of the Invention

This invention relates to a press-style perfume sprayer, particularly to one consisting of a body, a push block, a base, a rear side cover, a front side over, an upper cap and a perfume bottle. The rear side cover is pressed to push the push block to move up the perfume bottle to permit a nozzle on the upper cap to spray out the perfume in the perfume bottle. The press-style perfume sprayer in the invention has a structure convenient to use, easy to carry, protecting the perfume bottle from damaged or misused, and having an elegant and beautiful appearance.

2. Description of the Prior Art

Common conventional press-style perfume bottles mostly have a press-style nozzle on top and a sucking tube connected to the nozzle and extending in the bottle, and a cap closing up the nozzle to prevent it from pressing by mistake. But the cap often falls off or breaks owing to press with excessive force, and the perfume bottle itself has no protective member so that when the perfume bottle falls down on the ground, it may break or be cracked for the perfume to leak out. Further, it increases inconvenience because of its cap to be removed before using.

SUMMARY OF THE INVENTION

One objective of the invention is to offer a press-style perfume sprayer convenient to carry and easy to use.

Another objective of the invention is to offer a press-style perfume sprayer preventing a perfume bottle contained therein from misused or damaged and increasing its configurative beauty.

The feature of the invention is a body having a chamber for containing a perfume body and an aperture formed in an upper side, two studs and a long slot respectively formed in two side walls, two projections extending from the two side walls, and insert grooves formed in a rear wall; a push block combined with the bottom of the chamber of the body and having a recessed surface, a vertical strip on an outer surface of two side walls to fit in the long slots of the body, and sloped grooves formed in the bottom open to face the insert grooves of the body; a base surrounding the bottom of the body and having engage grooves to engage the projections of the body; a rear side cover pivotally combined with a rear side of the body and having push rods extending inward to insert in the insert grooves and in the sloped grooves of the push block; a front side cover pivotally combined with a front side of the body and having a pivot hole each in two side walls to fit with the studs of the body; an upper cap closing on top of the body and having a nozzle hole facing the aperture of the body; and a perfume bottle contained in the chamber of the body and having a nozzle head with a nozzle on top facing the aperture of the body, aligned to the nozzle hole of the upper cap and connected to a suck tube extending in the perfume bottle.

BRIEF DESCRIPTION OF DRAWING

This invention will be better understood by referring to the accompanying drawing, wherein.

DETAILED DESCRIPTION OF THE PREFERRED EMBODIMENT

Figure 1:
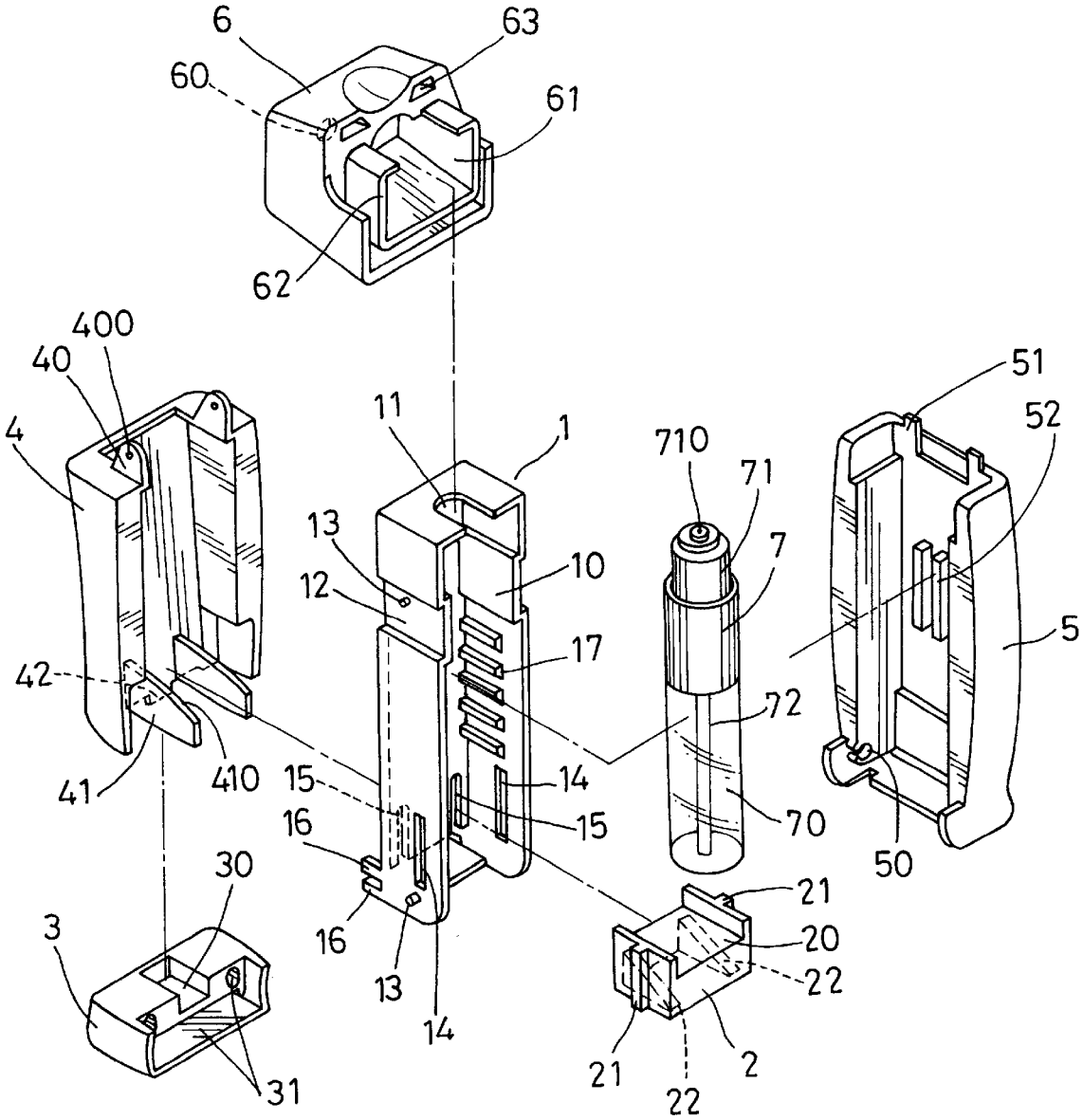
FIG. 1 is an exploded perspective view of a press-style perfume sprayer in the present invention.
Figure 2:
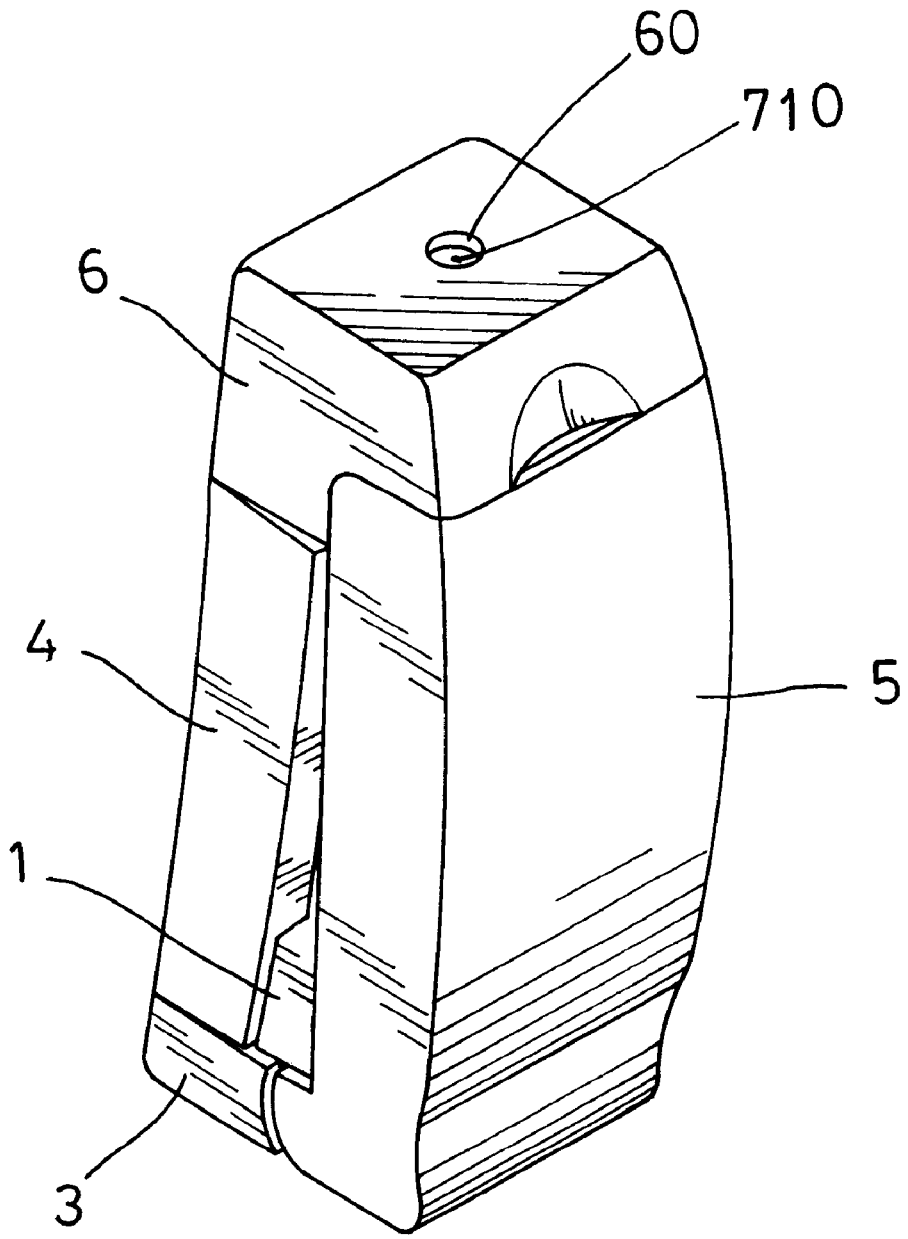
FIG. 2 is a perspective view of the press-style perfume sprayer in the present invention.

A preferred embodiment of a press-style perfume sprayer in the present invention, as shown in FIGS. 1 and 2, includes a body 1, a push block 2, a base 3, a rear side cover 4, a front side cover 5, an upper cap 6 and a perfume bottle combined together.

The body 1 has a chamber 10 provided in its interior for containing a perfume bottle therein, an aperture 11 formed in an upper wall, a recess 12 formed respectively in an upper outer portion of two opposite side walls, a stud 13 formed in a proper location on each recess 12, a vertical long slot 14 formed respectively in a lower portion of the two opposite side walls, two vertical insert parallel grooves formed in a lower end of a rear side wall, two rearward engage members 16 extending from a lower end of the two opposite side walls, and plural projective horizontal strips 17 formed respectively on an inner surface of the two opposite walls.

The push block 2 is deposited in a lower portion of the chamber 10 of the body 1, having a recessed upper flat surface 20, a vertical strip 21 formed respectively on an outer surface of two opposite walls to fit in the two long slots 14 of the body 1, and two parallel sloped grooves 22 formed in a bottom and having openings to face the insert grooves 15 of the body 1.

The base 3 is combined with the bottom of the body 1, having a recess 30 formed in an upper middle surface, and two lateral grooves 31 formed in a vertical wall in an intermediate portion to engage the engage members 16 of the body 1.

The rear side cover 4 is combined with a rear wall of the body 1, having a pair of projections 40 formed to protrude up from inner upper edges of two opposite side walls and provided respectively with a pivot hole 400 for the studs 13 of the body 1 to pivotally fit therein so as to secure combination of the rear side cover 4 with the body 1. In addition, the rear side cover 4 can swing with the studs 13 as pivots to facilitate pressing action. Further, the rear side cover 4 has two parallel push rods 41 extending inward from a lower portion to fit in the insert grooves 15 of the body 1 and in the sloped grooves 22 of the push block 2, and each push rod 41 has an upper curved surface 410 to contact the sloped groove 22 with the least dimensions so as to reduce friction force to smooth its sliding movement. A stop member 42 is provided to extend down from the bottom of the outer cover 4 to fit in the recess 30 of the base 3 to prevent the rear side cover 4 from moving out of the base 3.

The front side cover 5 is pivotally connected with a front side of the body 1, corresponding oppositely to the rear side cover 4, having a pivot holes 50 bored respectively in two lower side walls for the studs 13 of the lower portion of the body 1 to fit pivotally therein, two parallel projections 51 formed on an upper end, and plural vertical protective strips 52 spaced apart on an inner surface of a rear wall.

The upper cap 6 closes on the body 1, having a nozzle hole 60 in an upper side facing the aperture 11 of the body 1, a chamber 61 formed in its interior for containing an upper portion of the body 1, an insert plate 62 composted of two L-shaped plates and a bottom plate in the chamber 61, two parallel holes 63 formed in an upper middle vertical side to fit with the projections 51 of the front side cover 5.

The perfume bottle 7 is contained in the chamber 10 of the body 1, having a bottle body 70 formed in a lower portion and its bottom resting on the recessed surface 20 of the push block 2, a spray nozzle head 71 with a spray nozzle 710 fixed on top and fitted in the aperture 11 of the body 1 and also facing the nozzle hole 60 of the upper cap 6. Further, the spray nozzle head 71 has a flexible suck tube 72 extending in the bottle body 70.

Figure 3:
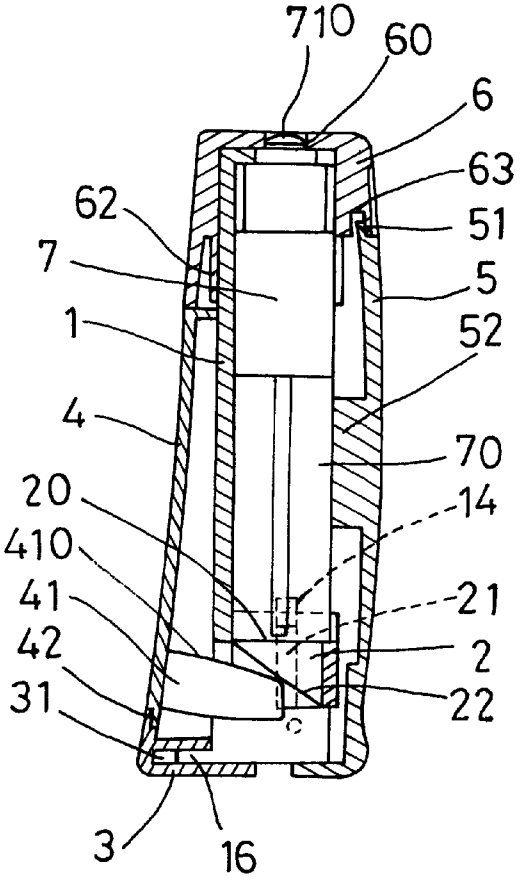
FIG. 3 is a cross-sectional view of the press-style perfume sprayer in the present invention, showing a first stage in using it; and, FIG. 4 is a cross-sectional view of the press-style perfume sprayer in the present invention, showing a second stage of using it.

In assembling, referring to FIGS. 1, 2 and 3, at first, combine the push block 2 in the bottom portion in the body 1, with the recessed surface facing upward, with the sloped grooves 22 facing the insert grooves 15 and with the projecting vertical strips 21 fitting in the long slots 14. Next, combine the base 3 under the bottom of the body 1, with the engage members 16 engaging the grooves 31 stably, and then place the rear side cover 4 on the rear side of the body 1. Align and push the pivot holes 400 of the two projections 40 to the studs 13 of the recess 12 of the body 1, letting the recesses 12 engaging the projections 40 to secure the rear side cover 4 with the body 1 stably. Then push the push rods 41 of the rear side cover 4 in the insert grooves 15 and further into the sloped grooves 22 of the push block 2, with the stop member 42 inserted in the recess 30 of the base 3. After that, the perfume bottle 7 is placed in the chamber 10, with the bottle body 72 having its bottom resting on the recessed surface 20 of the push block 2, with the nozzle head 71 with the spray nozzle 710 engaging in the aperture 11 of the body 1. Then pivotally combine the front side cover 5 on the front side of the body 1, and combine the upper cap 6 on the top of the body 1, with the nozzle 710 of the spray nozzle head 71 just facing the nozzle hole 60. Thus, the assembly of the press-style perfume sprayer is finished, with the body 1 and the front side cover 5 having the protective strips 17 and 52 on the inner wall surface firmly supporting and securing the perfume bottle 7 in the chamber 10 of the body 1.

Figure 4:
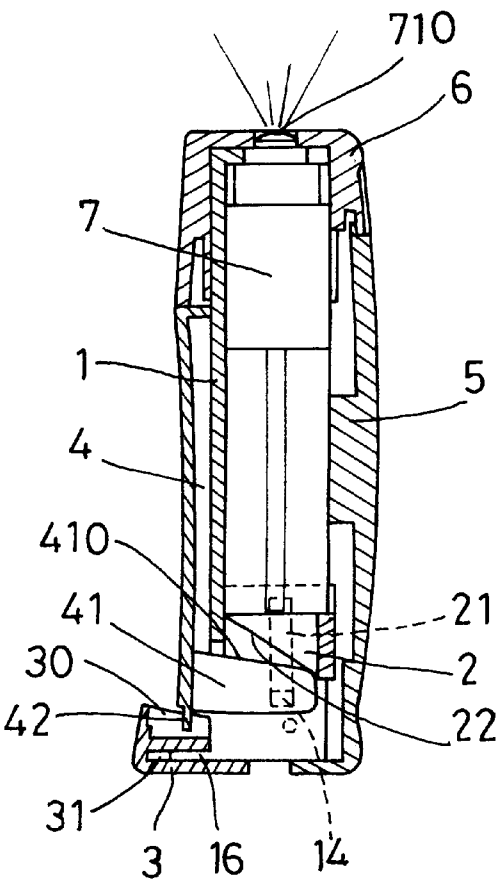

In using, referring to FIGS. 3 and 4, only press the rear side cover 4, letting the push rod 41 and the its upper side surface 410 slide along the sloped grooves 22, with the push block 2 pushing up the perfume bottle 7 resting on the recessed surface 20. Then a spring in the bottle compresses the suck tube 72 to suck up the perfume in the bottle 7 and sprayed out by the spray nozzle 710 of the spray nozzle head 71. If the rear side cover 4 is released after compressing, the spring recovers its resilience, with the bottle body 70 pushing down the push block 2 to the bottom, and at the same time the upper side surface 410 of the push rods 41 slides outward along the sloped grooves 22 so that the rear side cover 4 moves back to its original position.

In case the perfume bottle 7 is to be replaced with a new one, only remove the upper cap 6 from the body 1, with the front side cover 5 swinging outward with the stud 13 fitting pivotally in the pivot hole 50 as a pivot. Then the old perfume bottle 7 is taken out of the body 1, and a new one is placed in the chamber 10 of the body 1, with the spray nozzle 710 of the spray nozzle head 71 engaging in the aperture 11. Then close the front side cover 5 and the upper cap on the body 1 again.

The press-style perfume sprayer in the invention has the following advantages, as can be understood from the aforesaid description.

1. Its assembly is simple and easy, quick to replace the perfume bottle, with the perfume bottle stably secured inside and easy and quick to use.
2. It is handy to carry out, effectively protecting the perfume bottle from misused or damaged.
3. It has an elegant fresh appearance and innovative idea and practicality.

While the preferred embodiment of the invention has been described above, it will be recognized and understood that various modifications may be made therein and the appended claims are intended to cover all such modifications that may fall within the spirit and scope of the invention.

What is claimed is:

1. A press-style perfume sprayer comprising:

a body having a chamber in its interior, an aperture formed in an upper end, a stud and a long vertical slot respectively provided in a lower portion of two opposite side walls, two parallel insert grooves formed in a rear side, and two engage members protruding rearward from a lower end of said two opposite side walls;

a push block combined with a bottom of said chamber of said body, having an upper side surface, a vertical strip respectively formed on an outer surface of two side walls to fit in said long slots of said body, two parallel sloped grooves formed in its bottom and having one open side fitting in said insert grooves of said body;

a base surrounding a bottom of said body, having two engage grooves formed lateral in an intermediate vertical side to engage said engage members of said body;

a rear side cover pivotally connected to a rear side of said body, having two push rods extending inward from a lower end and inserting in said insert grooves and also in said sloped grooves of said push block;

a front side cover pivotally connected to a front side of said body, having pivot holes formed in two opposite walls for said studs to pivotally fit therein;

an upper cap closing on top of said body, having a nozzle hole bored in an upper end and facing said aperture of said body;

a perfume bottle contained in a chamber of said body, having a lower bottle body, a spray nozzle head with a spray nozzle provided on top of said perfume bottle, and a suck tube connected to said spray nozzle head and extending in said lower bottle body, a bottom resting on said recessed surface of said push block, said nozzle engaging in said aperture of said body and facing said nozzle hole of said upper cap;

said rear side cover compressed inward to force said push rods slide on said sloped grooves of said push block, a spring in said perfume bottle then compressed accordingly to suck up the perfume in said lower bottle and sprayed out of said spray nozzle, said push block recovering its position when said rear side cover is released after compression, said press-style perfume sprayer having an elegant beautiful appearance and protecting said perfume bottle from misused or damaged, easy to carry and simple to use.

2. The press-style perfume sprayer as claimed in claim 1, wherein said body has a recess formed respectively in an upper portion of said two opposite side walls, a stud formed on each said recess, and said two engage members of said two opposite side walls are located spaced apart vertically.

3. The press-style perfume sprayer as claimed in claim 1, wherein said base has a recess in an upper middle portion.

4. The press-style perfume sprayer as claimed in claim 1, wherein said rear side cover has two projections with a pivot hole formed on an upper edge, said projections pivotally connected to said recesses and said studs of said body, said projections engaging said recesses to secure said rear side cover with said body; said two push rods of said rear side cover respectively having an upper curved side surface to reduce contact dimensions with said sloped grooves of said push block for lessening mutual friction so as to let said rear side cover to move smoothly; said rear side cover having a stop member provided to protrude outward from a lower portion to face said recess of said base so that said rear side cover may not separate from the body when swinging outward.

5. The press-style perfume sprayer as claimed in claim 1, wherein said upper cap has a chamber open to a front and an upper side, an insert plate consisting of two L-shaped side walls standing upright from a bottom wall, said insert plate placed in said chamber and forming a hollow space after said upper cap is combined with said front side cover and said body.

6. The press-style perfume sprayer as claimed in claim 1, wherein said front side cover has two projections on an upper side, and said upper cap has two grooves for said two projections to fit therein when said upper cap is combined on the rear side cover.

7. The press-style perfume sprayer as claimed in claim 1, wherein said body and said front side cover have plural protective strips formed on their inner walls for pushing and protecting said perfume bottle contained in said chamber of said body.

* * * * *